US010655943B2

(12) United States Patent
Abramov

(10) Patent No.: US 10,655,943 B2
(45) Date of Patent: May 19, 2020

(54) MORTAR SYSTEM WITH IMPROVED GAS SEAL

(71) Applicant: Igor Abramov, Vista, CA (US)

(72) Inventor: Igor Abramov, Vista, CA (US)

( * ) Notice: Subject to any disclaimer, the term of this patent is extended or adjusted under 35 U.S.C. 154(b) by 190 days.

(21) Appl. No.: 15/861,443

(22) Filed: Jan. 3, 2018

(65) Prior Publication Data

US 2019/0204055 A1 Jul. 4, 2019

(51) Int. Cl.
*F42B 14/00* (2006.01)
*F41F 1/06* (2006.01)
*F42B 30/12* (2006.01)

(52) U.S. Cl.
CPC ..... *F42B 14/00* (2013.01); *F41F 1/06* (2013.01); *F42B 30/12* (2013.01)

(58) Field of Classification Search
CPC ..... F42B 14/00; F42B 14/02; F42B 14/061; F42B 14/06; F42B 30/10
See application file for complete search history.

(56) References Cited

U.S. PATENT DOCUMENTS 3,023,704 A * 3/1962 Dawson ..... F42B 14/02 102/525
3,613,596 A * 10/1971 Walde ..... A61K 31/00 102/525
3,687,079 A * 8/1972 Scollins ..... F42B 14/02 102/526
4,444,113 A * 4/1984 Campoli ..... F42B 14/02 102/430
6,295,934 B1 * 10/2001 Tepera ..... F42B 14/02 102/525
6,453,821 B1 * 9/2002 Fowler ..... F42B 14/02 102/520
6,782,830 B1 * 8/2004 Candland ..... F42B 14/02 102/439
7,040,237 B2 * 5/2006 Tilling ..... F42B 14/02 102/524
7,273,012 B2 * 9/2007 Melody ..... F41A 9/39 102/481

OTHER PUBLICATIONS

Jasse shows a compliant obturating ring which moves under pressure of propelling gasses.
Fowler et al. shows obturating ring on a guided projectile fired from a cannon, where the ring moves upon firing.

* cited by examiner

*Primary Examiner* — Benjamin P Lee

(57) ABSTRACT

An obturator ring (4) for a mortar round (2) is proposed where the geometry of the ring (4) is modified by its sliding and striking stationary anvil (18) when the round (2) is placed in the muzzle-loaded mortar's barrel (6) and reaches its bottom. The initial ring (4) geometry does not impede round's travel down the barrel (6) while its modified geometry provides a gas seal between the round (2) and the barrel (6) wall.
Several embodiments featuring free-rotating (4), splined non-rotational (4*a*) and stationary separated (12*a*-14*a*) designs are presented.
The ring works with both smoothbore and rifled mortar barrels and in several embodiments imparts rotation to the round (2) if used in a rifled barrel (6).
An optimized muzzle-loaded mortar barrel (6) operating in cooperation with rounds equipped with the obturator ring of instant invention is also presented, containing rifled (6*a*) and smoothbore (6*b*) sections.

19 Claims, 6 Drawing Sheets

MORTAR SYSTEM WITH IMPROVED GAS SEAL

CROSS-REFERENCE TO RELATED APPLICATION

This application claims the benefit of provisional patent application Ser. No. 62,451,069 filed 2017 Jan. 27, titled "Mortar System".

FIELD OF INVENTION

This invention relates in general to mortar systems, and in particular to mortar rounds and muzzle-loaded rifled mortar barrels.

BACKGROUND OF INVENTION

In the operation of a mortar, a mortar round is dropped into the mortar barrel where it falls toward the barrel's bottom and strikes the firing pin. The round's propelling charge is then ignited and the resulting propelling gasses expel the round out of the barrel.

In order for the round to be easily inserted and for it to proceed unimpeded to the bottom of the barrel, there has to be a sufficient clearance between the round and the barrel's inner wall. However, when the propelling charge is ignited and propelling gases generated, a gas seal has to be formed between the round and the barrel in order for the gasses to expel the round from the barrel.

To provide such a seal, the round contains an 'obturator' (sealing) ring positioned in its widest section. This ring customarily has a split design which, while not impeding the round's travel down the barrel, enables the ring to expand under pressure of the propelling gasses and provide a seal between the round and the barrel.

The present obturators rings, however, do not provide adequate seals, and some propelling gasses escape, thus reducing the energy and the resulting range of the round. Also, the present design of the obturator rings prevents their use with rifled mortar barrels. Without a rifled barrel the round does not spin and its accuracy is diminished as a result.

There is a rifled mortar system made by TDA Armements SAS of France ('TDA') which has its rounds containing a special obturator ring with splines matching the rifling of the barrel. However, the system requires a careful round insertion with aligning of the round's splines to the barrel rifling. This presents a difficulty in high-stress combat environments and requires high degree of cleanliness of the barrel as well as the round's ring, lest the round be jammed on its way down the barrel. Still, by necessity, there has to be sufficient clearance between the ring's and barrel features to enable the round's travel down the barrel. These clearances create channels for the propelling gas' escape. So, while greatly improving the round's accuracy by imparting a spin to it, the system still has shortcomings in terms of ease and reliability of operation and reduction of the potential range of its rounds.

The rifled barrel working with the splined ring has been limited only to one larger caliber 155 mm system by TDA. The adoption of this system for smaller caliber mortars has not happened, some of the reasons being that smaller caliber systems would be more susceptible to fouling and difficulties inserting the round since their rifling would be proportionately smaller and their rounds lighter than the larger caliber's to overcome any friction they may encounter while traveling down the barrel.

OBJECTIVES OF THE INVENTION

Thus, it is the objective of instant invention to provide a mortar round with an improved gas seal to the mortar barrel.

Another objective of instant invention is to provide a mortar round that would be compatible with both smoothbore and rifled mortar barrels.

Yet another objective of instant invention is to provide a mortar round which would be easy to muzzle load into the barrel.

Another objective of instant invention is to provide a rifled mortar barrel and a mortar round which in cooperation would provide an improved energy transfer and spin to the round thus extending its range and improving its accuracy.

SUMMARY OF THE INVENTION

In accordance with the present invention, a mortar round has an obturator ring which changes its geometry essentially prior to the ignition of the propelling charge. The ring is made to slide along the mortar round, and is held in its initial position on the round while the round is inserted into the barrel.

The round travels down the barrel, and as it strikes the barrel's bottom, the ring continues to travel due to its inertia and strikes a special anvil feature of the round. Upon striking the anvil, the ring flares out and seals the aperture of the barrel.

Subsequently the gasses generated by the ignited propelling charge maintain the flared shape of the ring while driving it along the round. When the ring reaches the end if its travel, the round itself is propelled.

Two configurations of the obturator ring are presented: one is a free-fitting type, another having longitudinal splines which mate with the corresponding splines on the round. The latter configuration enables transfer of rotation of the ring to the round, as the ring follows rifling inside the mortar barrel. The former configuration is a lower-cost between the two.

Also presented is an optimized mortar barrel having one smoothbore section and one rifled section, to ensure better interaction with the obturator ring of instant invention.

Thus, not only the ring's design ensures a better gas seal between the round and the barrel, but also the round now can be used in rifled barrels and acquire a spin as a result.

Upon round's exit from the barrel the ring assumes its initial compact form to maintain aerodynamics of the round.

PRIOR ART

The prior art is comprised of several patents (none presently adopted to practice) featuring various designs of sliding obturator rings which would slide up on an essentially conical section of the round and provide gas seal between the round and the barrel. For example, U.S. Pat. No. 3,143,074 to Jasse, describes such a ring.

In all prior art, the expansion of the obturator ring itself or its movement to seal the bore of the barrel are directly effected by the expanding propelling gasses.

In case of the sliding ring there is a delay in the sealing action due to the finite speed of the ring. Arguably, before the ring starts to move, expanding propelling gases flow around it and tend to compress it against the round, thus increasing friction between it and the round and further slowing the ring's movement to its sealing position.

Additionally, the sliding movement of the ring can be compromised by a cold ambient temperature, since it will affect both the ring's sliding motion itself due to increased friction and contracted ring diameter, as well as ring's material increased stiffness.

In case of a ring of the split design, the seal itself is somewhat compromised by the very gap in the ring, even though it is oblique. In addition, the required expansion of the ring under the action of the propelling gasses presumes the gasses reaching underneath and around the ring in order to expand it, which inevitably involves escape of some gas fraction and the resulting decrease in energy transferred to the round.

OBJECTS AND ADVANTAGES

In contrast to the prior art mentioned hereinabove, the instant invention provides a positive seal between the mortar round and the barrel prior to- or simultaneously with the ignition of the propelling charge. A better seal results in a greatly minimized gas loss, which in turn leads to more energy being transferred to the round and its subsequent flying over a longer distance.

In addition, the instant invention provides a capability of using a mortar round in rifled muzzle-loaded barrels as well as smoothbore ones.

Because the ring operation does not depend on the pressure of the propelling gasses, it offers reliable seal even with small propelling charges and at the reduced pressure of propelling gasses.

The instant invention also permits a greater clearance between the barrel and the round due to a greater expansion of the obturator ring. Such increased clearance ensures better reliability of the system and its enhanced resistance to barrel fouling.

DESCRIPTION OF THE EMBODIMENTS

In the foregoing description like components are labeled by the like numerals.

Figure 1:
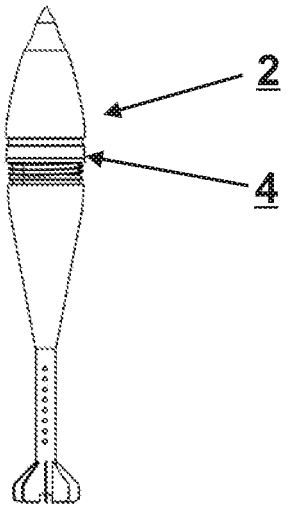
FIG. 1 is an elevation view of a mortar round with the obturator ring in storage/flight position.
Figure 2:
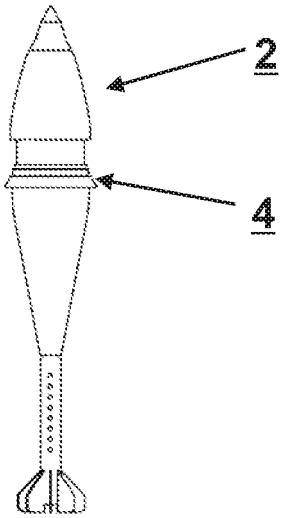
FIG. 2 is an elevation view of a mortar round with the obturator ring in activated position.

Mortar round embodiment 2 comprising obturator ring assembly 4 is shown on FIGS. 1 and 2. FIG. 1 shows round 2 in the storage/flight configuration. FIG. 2 shows round 2 with obturator ring 4 in activated configuration.

Figure 11:
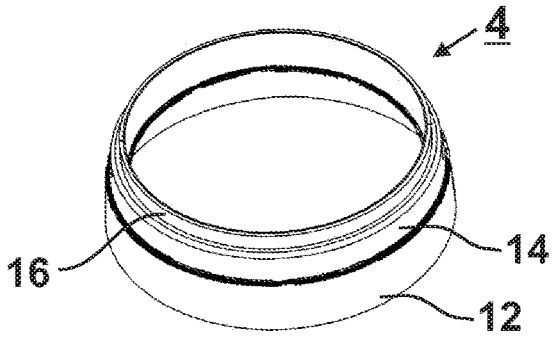
FIG. 11 is a perspective view of the obturator ring in storage/flight configuration.
Figure 12:
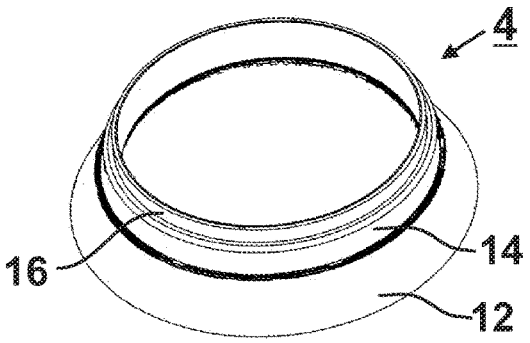
FIG. 12 is a perspective view of the obturator ring in activated configuration.

Ring assembly 4 is initially held in storage position and allowed to slide along round 2 for activation. Ring embodiment 4 is shown separately on FIGS. 11 and 12.

Figure 6:
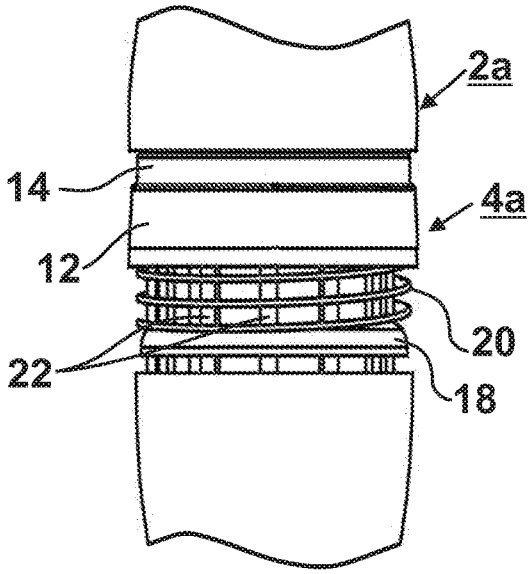
FIG. 6 is a fragmentary elevation view of an alternative embodiment of the mortar round with the obturator ring in storage/flight position
Figure 7:
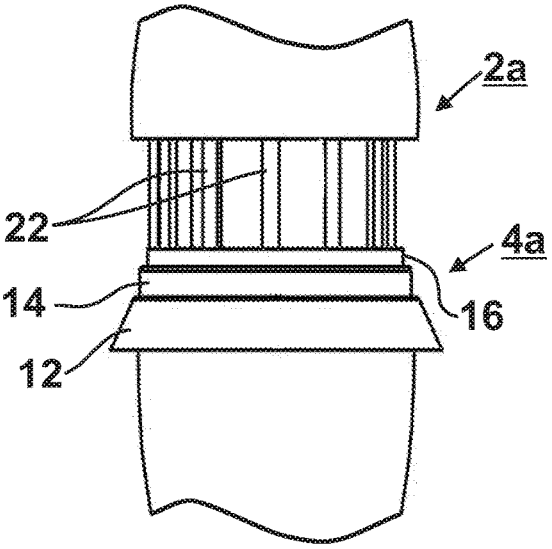
FIG. 7 is a fragmentary elevation view of an alternative embodiment of the mortar round with the obturator ring in activated position.
Figure 8:
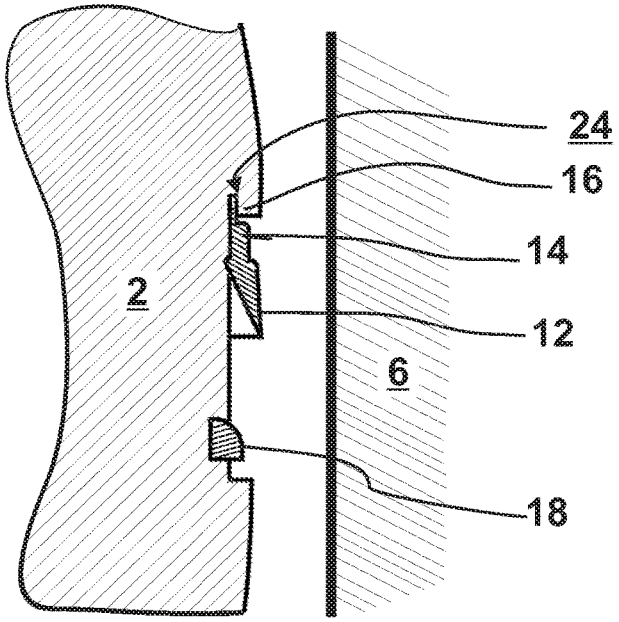
FIG. 8 is a fragmentary cross-section of the mortar round with the obturator ring in storage/flight position
Figure 9:
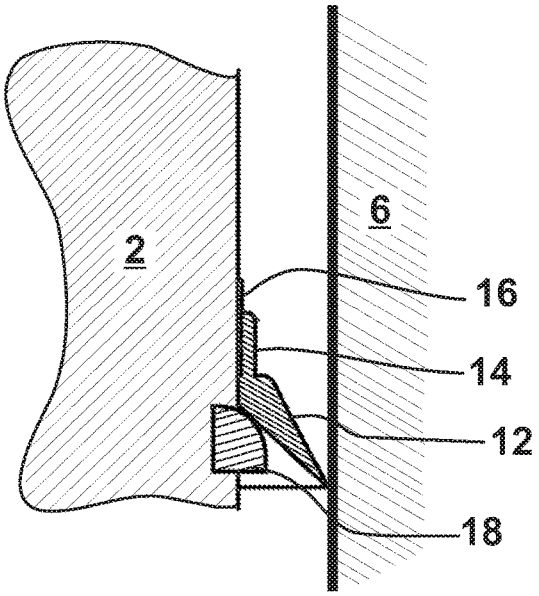
FIG. 9 is a fragmentary cross-section of the mortar round with the obturator ring in activated position.
Figure 13:
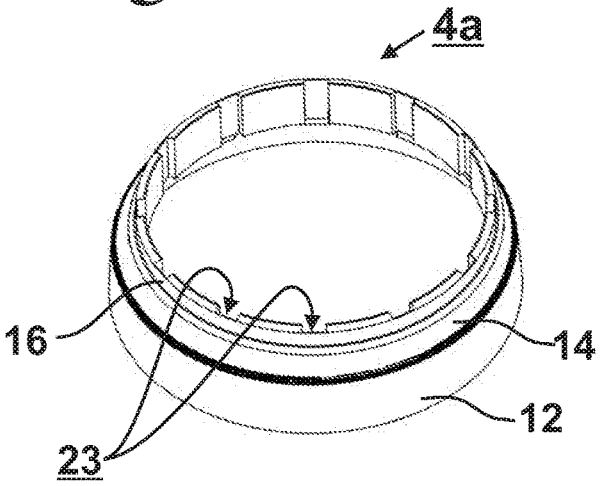
FIG. 13 is a perspective view of the obturator ring alternative embodiment in storage/flight configuration.
Figure 14:
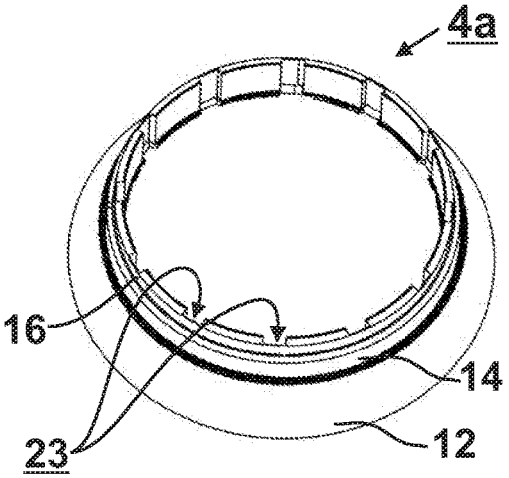
FIG. 14 is a perspective view of the obturator ring alternative embodiment in activated configuration.
Figure 15:
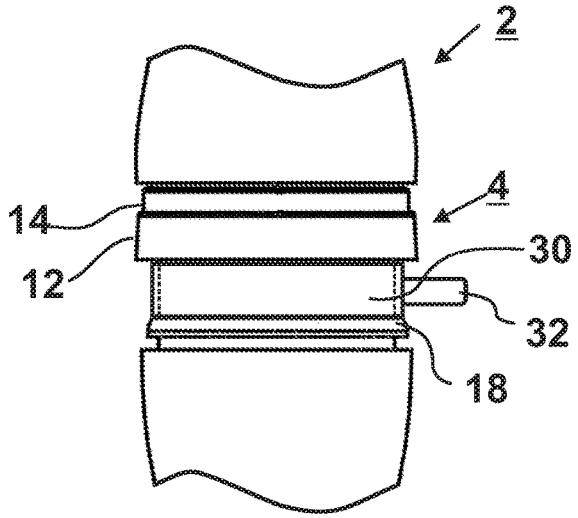
FIG. 15 is a fragmentary elevation view of the mortar round with the obturator ring in storage position.
Figure 16:
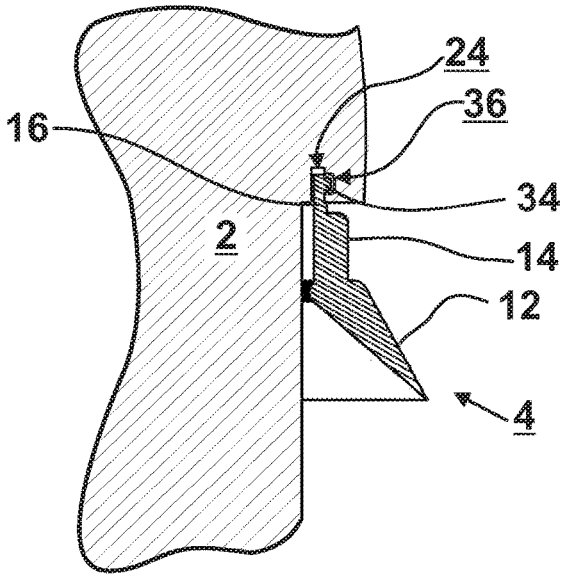
FIG. 16 is a fragmentary cross-section of the mortar round alternative embodiment with the obturator ring in early flight position.

An alternative round embodiment 2*a* having longitudinal splines 22 is shown on FIGS. 6 and 7. Corresponding ring embodiment 4*a* comprising complementary longitudinal splines is shown on FIGS. 13 and 14.

An alternative embodiment with separate weighted ring section 14*a* and sealing section 12*a* is shown on FIGS. 17 through 20.

Operation

Referring to FIGS. 1, 2, 8, 9, 11, 12 and 16 obturator ring 4 comprises annular weighted section 14 connected to annular compliant sealing section 12. Weighted section 14 in addition has annular sealing collar 16 located in its outer edge.

Referring to FIGS. 1, 4, 15 and 16, round 2 comprises obturator ring 4 in the storage position. The ring is held in this position by either retaining spring 20, disposable retaining hoop 30 comprising grab handle 32, or the ring's integral retaining resilient tab 34 interfacing with groove 36 in the round 2's case.

In its storage configuration the sealing section's 12 diameter is equal to or smaller than the outer diameter of the round 2 to permit its muzzle loading and unimpeded travel to the barrel's bottom.

When round 2 reaches the bottom of the barrel and is stopped there, the ring 4 continues its movement due to its inertia. It then strikes annular anvil 18, and the compliant sealing section 12 flares out as a result. As a consequence, section 12's outer diameter is increased until it touches the inner wall of the barrel, thus providing a positive seal between it and therefore, the round, and the barrel.

Figure 10:
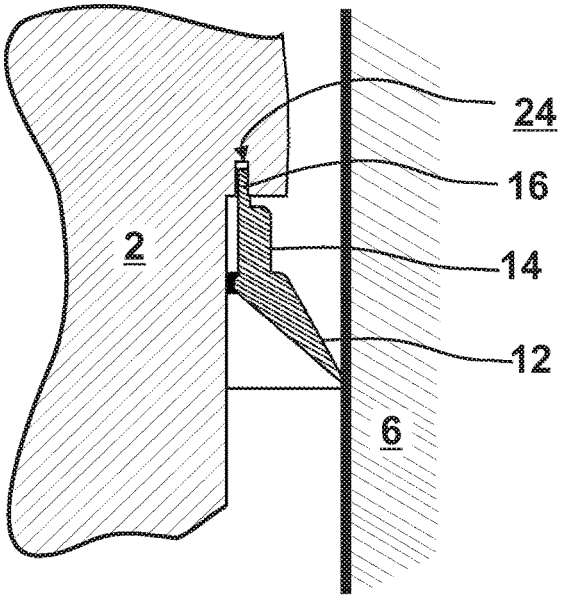
FIG. 10 is a fragmentary cross-section of the mortar round with the obturator ring in activated/early flight position

Upon round 2's striking the firing pin at the bottom of the barrel or shortly thereafter the round 2's propelling charge is ignited and the generated gasses provide an added pressure to maintain the flared shape of sealing section 12 for a more robust seal, while propelling the ring along the round's 2 surface into its terminal position shown on FIG. 10. In this position the ring's sealing collar 16 enters an annular groove 24 in round 2's case for still a tighter gas seal.

The round 2 is then expelled by the propelling gasses out of the barrel. Ring 4 sealing section 12, being resilient and not subject to the pressure of the propelling gasses anymore, assumes its initial compact shape which improves the aerodynamics of the round for the duration of the remaining flight to the target.

Additional Embodiments

In the foregoing description like components are labeled with like numerals. An alternative embodiment 2*a* of the round is illustrated on FIGS. 6 and 7. This embodiment features longitudinal splines 22 on the round 2*a* case. The corresponding obturator ring 4*a* depicted on FIGS. 13 and 14, comprises longitudinal recesses 23 which mate with splines 22 on round 2*a*. Because these alignment features are not exposed to fouling by combustion products, their machined tolerances can be quite tight, thus ensuring a tight gas seal. Additional sealing measures can be undertaken, such as making tightly-mated splines and their respective grooves of high lubricity material, such as nylon or PTFE) (Teflon®).

When round 2*a* is used in a rifled barrel, sealing section 12 upon being flared on anvil 18 enters rifling grooves of the barrel and is engraved by them. As the round is being expelled from the barrel, sealing section 12 follows the rifling grooves of the barrel, together with the entire ring 4*a*.

Because relative rotation of ring 4*a* with respect to round 2*a* is prevented by ring's recesses 23 engaging round's splines 22, sealing section 12 transfers its rotation to round 2*a*. Thus, by the time round 2*a* emerges from a rifled barrel it has acquired a spin.

Figure 3:
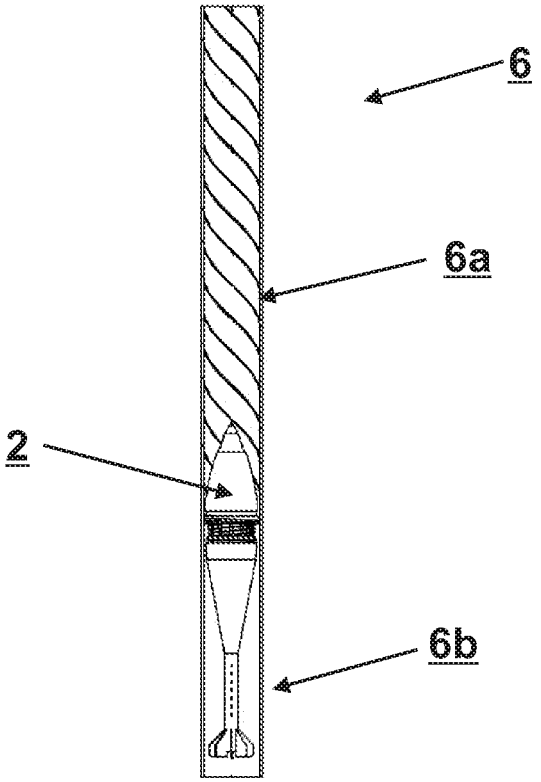
FIG. 3 is a cross-section of the mortar barrel with a mortar round inside.
Figure 4:
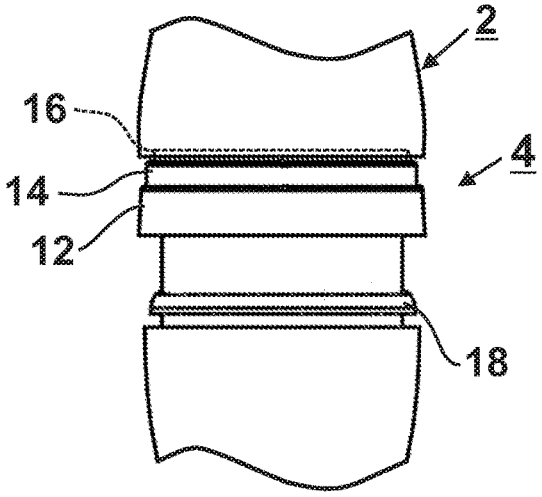
FIG. 4 is a fragmentary elevation view of a mortar round with the obturator ring in storage/flight position
Figure 5:
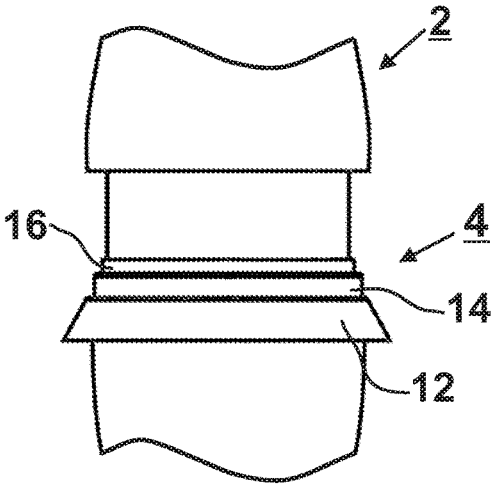
FIG. 5 is a fragmentary elevation view of a mortar round with the obturator ring in activated position.

While the ring's flared section would readily conform to the rifling grooves of the barrel, a better seal with the rifling grooves would be realized if the ring expands inside a smooth section of the barrel and then enters the rifled section. Such construction of the barrel is illustrated on FIG. 3 where barrel 6 comprises two sections: rifled section 6*a* and smoothbore section 6*b*. Smoothbore section 6*b* is designed to enable the full flare-out of ring's 4*a* section 12 prior to its entering barrel's rifled section 6*a*.

Obturator rings 4 and 4*a* can be made as an integrated piece or as an assembly of a preferably metal weighted section 14 and a compliant sealing section 12. Alternatively, sections 12 and 14 can be made of a lightweight material with a weighted core embedded into section 14.

The materials for compliant sealing section 12 can be nylon, stainless- and carbon steel (in thin cross-sections), phosphor bronze, super-elastic nickel-titanium alloys ('nitinol') or similar resilient materials or a combination thereof. For example, sealing section 12 as well as the entire ring 4 or 4*a* can be made of a composite material having a reinforcing matrix and any other strength/weight members embedded into an elastomeric material.

Other features can be incorporated into the obturator ring. For example, the ring sealing section 12 edge can be coated with a softer material to enable a better seal between it and the rifling grooves of the barrel. Also, section 12 edge can be pre-coated with a lubricant such as high-temperature grease or graphite, or, in case of metallic construction, with a titanium nitride (TiN) coating, or made of a high lubricity material, such as PTFE (Teflon®).

Figure 17:
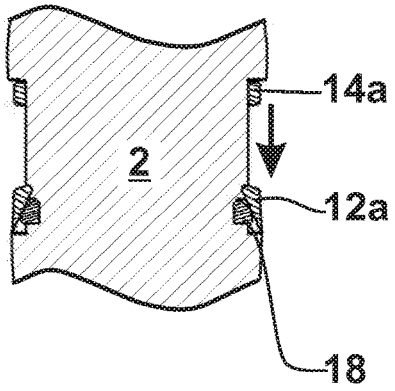
FIG. 17 is a fragmentary cross-section of the mortar round with alternative embodiment of the obturator ring in storage position
Figure 18:
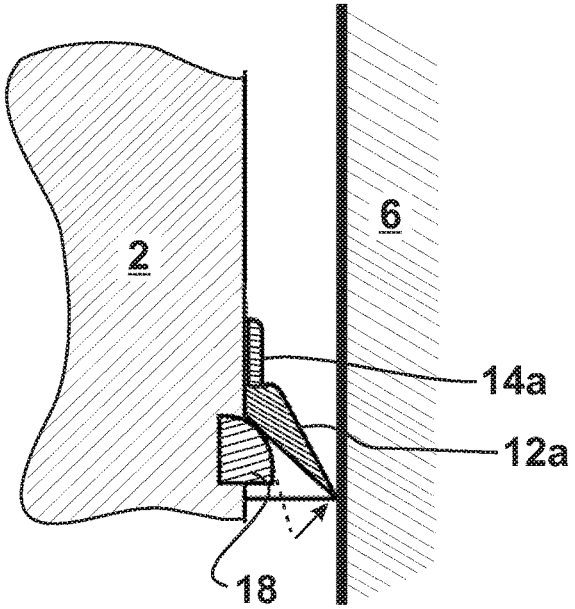
FIG. 18 is a fragmentary cross-section of the mortar round with alternative embodiment of the obturator ring in deployed position

An alternative embodiment of the obturator ring assembly is shown on FIGS. 17 and 18. Weighted section 14*a* is separate from sealing section 12*a*. Sealing section 12*a* is permanently mounted on round 2, with section 14*a* sliding along the round's surface. When the round strikes the bottom of the barrel, section 14*a* strikes section 12*a* which flares out on anvil 18 thus providing a gas seal between round 2 and barrel 6 wall.

Because section 12*a* is stationary with respect to the round, a better overall gas seal can be obtained. Internal anchoring keys can be provided between round 2 case and section 12, to prevent its spinning independently from the round. This would ensure that section 12*a* while following the rifling of a rifled barrel, imparts spin to the round.

Figure 19:
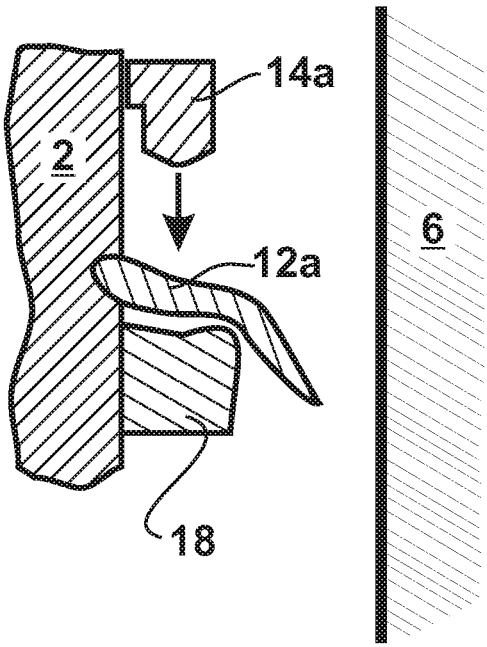
FIG. 19 is a fragmentary cross-section of the mortar round with alternative embodiment of the obturator ring in storage position
Figure 20:
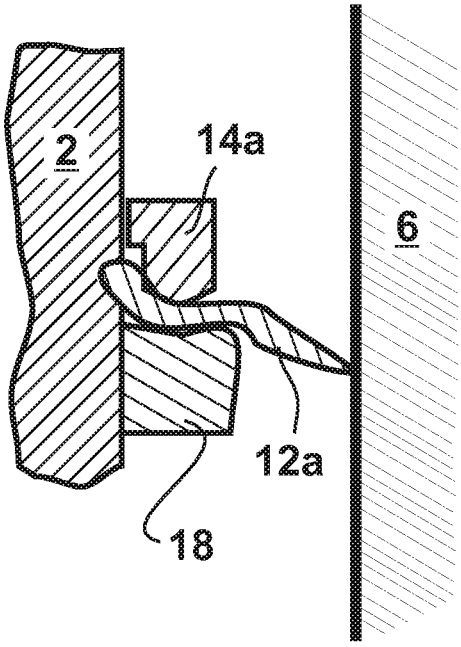
FIG. 20 is a fragmentary cross-section of the mortar round with alternative embodiment of the obturator ring in deployed position

As shown on FIGS. 19 and 20 section 14*a* can have an essentially convex lower striking surface which in cooperation with a concave upper surface of anvil 18 would deform compliant sealing section 12*a* sufficiently for it to seal barrel 6.

In addition, section 14*a* can be made frangible so it would disintegrate upon round's exit from the barrel. During storage section 14*a* can be secured by the same means as complete ring assemblies 4 and 4*a*, namely, a) retaining spring 20, b) disposable retaining hoop 30 comprising grab handle 32, or c) the section 14*a* can have an integral retaining resilient tab similar in shape and function to tab 34 interfacing with groove 36 in the round 2's case.

The round itself may be modified to optimize the system's operation with a slightly delayed ignition of the propelling charge from the moment of striking the firing pin, to account for the obturator ring assemblies 4, 4*a* or just section 14*a* travel and to ensure full expansion of the sealing sections 12 or 12*a*. Our calculations show that for a system of an average caliber this delay may be in the order of 0.1 seconds. Primers in present rounds, however, may provide such delay already.

Additionally, frangible or fracture-inducing elements and design features can be included in the ring and/or its components, so they disintegrate upon round's exit from the barrel.

Although specific embodiments have been hereinabove described, many modifications and changes may be made without departing from the scope of instant invention.

Thus, the scope of this invention should be determined from the appended claims and their legal equivalents.

I claim:

1. A mortar system comprising:

a combination of a barrel and a projectile fired therefrom, said barrel having substantially tubular shape, said barrel having an open muzzle end and an opposing sealed end, said barrel used in a substantially upright position, wherein said muzzle end points in a substantially upward direction, said projectile comprising a substantially ogive nose section, a substantially cylindrical middle section and a tail section, said projectile further comprising a propelling charge located substantially in said tail section, said projectile further comprising a propelling charge initiator located in said tail section, said projectile insertable by said tail section first into said muzzle end of said barrel, said projectile after insertion moving substantially downward inside said barrel by the action of gravity, said projectile having its maximum diameter at said middle section, said barrel having inner diameter larger than said maximum diameter of said projectile, said projectile further comprising obturator mechanism, said obturator mechanism energized by the force of gravity, said obturator mechanism further comprising an annular deformable obturator ring, said obturator ring comprising an uninterrupted annular structure, said obturator ring further stationary mounted onto said projectile, said obturator ring capable of assuming two shapes, namely, a) an initial shape having outer diameter smaller than said inner diameter of said barrel, said initial shape permitting unimpeded downward movement of said projectile inside said barrel, and b) a deformed shape having outer diameter generally equal to said inner diameter of said barrel, said obturator mechanism further comprising obturator ring deforming element, said deforming element further comprising a weighted annular structure, said deforming element mounted between said obturator ring and said nose section of said projectile, said deforming element slidably movable along the longitudinal axis of said projectile, said deforming element moving toward said obturator ring by action of inertia after said tail section of said projectile strikes said sealed end of said barrel, said deforming element subsequently contacting said obturator ring, said deforming element subsequently deforming said obturator ring from said initial shape into said deformed shape, wherein said obturator ring upon assuming said deformed shape creates a gas seal between said projectile and said internal surface of said barrel, said projectile after striking said sealed end of said barrel causing said initiator after a delay to ignite said propelling charge, said propelling charge generating propelling gas after ignition, wherein said propelling gas is contained inside said barrel by said gas seal, wherein said propelling gas expels said projectile from said barrel, wherein said obturator ring assumes said deformed shape prior to ignition of said propellant charge.

2. The projectile of claim 1 wherein said obturator ring reverts to said initial shape when said projectile exits said barrel.

3. A mortar system comprising:

a combination of a barrel and a projectile fired therefrom, said barrel having a substantially tubular shape, said barrel having an open muzzle end and an opposing sealed end, said barrel used in a substantially upright position, wherein said muzzle end points in a substantially upward direction, said projectile comprising a substantially ogive nose section, a substantially cylindrical middle section and a tail section, said projectile further comprising a propelling charge located substantially in said tail section, said projectile further comprising a propelling charge initiator located in said tail section, said projectile insertable by said tail section first into said muzzle of said barrel, said projectile after insertion moving downward inside said barrel by the action of gravity, said projectile having its maximum diameter at said middle section, said barrel having inner diameter larger than said maximum diameter of said projectile, said projectile further comprising obturator mechanism, said obturator mechanism energized by the force of gravity, said obturator mechanism further comprising an annular deformable obturator ring, said obturator ring comprising an uninterrupted annular structure, said obturator ring further stationary mounted onto said projectile, said obturator ring further capable of assuming at least two shapes, namely, a) an initial shape having outer diameter smaller than said inner diameter of said barrel, said initial shape permitting unimpeded downward movement of said projectile inside said barrel under a force of gravity, and b) a deformed shape having outer diameter generally equal to said inner diameter of said barrel, said obturator mechanism further comprising an annular anvil, said anvil stationary mounted on said middle section of said projectile between said deformable obturator ring and said tail section, said anvil further mounted in close proximity to said deformable obturator ring, said obturator mechanism further comprising a slidably movable annular deformer, said deformer capable of moving under the force of gravity from an initial position on said middle section of said projectile and proceeding longitudinally along said middle section, said initial position located on said middle section proximally to said nose section of said projectile, said movement of said deformer terminating in said deformer striking said obturator ring, said obturator ring deformed by cooperation of said deformer and said anvil, wherein said obturator ring upon being deformed creates a gas seal between said projectile and said internal surface of said barrel, wherein said projectile after striking said sealed end of said barrel causes said initiator to ignite after a delay said propelling charge, said propelling charge generating propelling gas after ignition, wherein said propelling gas is captured inside said barrel by said gas seal, wherein said propelling gas expels said projectile from said barrel, wherein said obturator ring assumes said deformed shape prior to ignition of said propellant charge.

4. The deformer of claim 3 further comprising a substantially toroidal striking surface.

5. The anvil of claim 3 further comprising a substantially concave annular receiving surface substantially complementary of said deformer.

6. The anvil of claim 3 integrally formed in said middle section of said projectile.

7. The deformer of claim 3 wherein said deformer is temporarily retained in said initial position by a retaining element prior to insertion of said projectile into said barrel.

8. The projectile of claim 3 wherein said obturator ring reverts to said initial shape when said projectile exits said barrel.

9. A mortar system, comprising a substantially tubular barrel and a projectile, said projectile comprising a nose section, a middle section and a tail section, said barrel comprising an open muzzle end and an opposing sealed end, said barrel deployed in substantially vertical position with said muzzle end pointing substantially upward, said projectile further comprising obturator mechanism, said obturator mechanism comprising deformable obturator ring, wherein said obturator ring is slidably movable along said middle section of said projectile, said obturator ring further capable of assuming at least two shapes, namely, a) an initial shape having outer diameter smaller than said inner diameter of said barrel, said initial shape permitting unimpeded downward movement of said projectile inside said barrel under the force of gravity, and b) a deformed shape having outer diameter generally equal to said inner diameter of said barrel, wherein said obturator ring is further capable of assuming at least two positions on said middle section, namely, a) a first position and b) a second position, wherein said first position is located on said middle section on its end proximal to said nose section of said projectile, wherein said second position is located on said middle section proximal to said tail section of said projectile, wherein said middle section further comprises an annular stop element located in proximity to said first position between said first position and said nose section, said stop having outer diameter substantially smaller than said outer diameter of said middle section of said projectile, wherein said stop comprises an annular gas sealing element capable of accepting said obturator ring, said seal having outer diameter smaller than said outer diameter of said middle section, wherein said obturator mechanism further comprises a deforming element, said deforming element causing said obturator ring to deform, wherein said deforming element comprises an annular anvil, said anvil stationary mounted onto said middle section in general proximity to said second position of said obturator ring, wherein said obturator ring is slidably movable from said first position to said second position by action of inertia when said projectile reaches the sealed end of said barrel, wherein said obturator ring by action of inertia strikes said anvil in said second position, wherein said obturator ring upon striking said anvil assumes said deformed shape, wherein said obturator ring upon assuming said deformed shape creates a gas seal between itself and said inner surface of said barrel, wherein said propelling gas propels said obturator ring to said first position, wherein said obturator ring is stopped by said stop in said first position, wherein said obturator ring and said annular sealing element in cooperation create an additional gas seal while in said first position, wherein said obturator ring assumes said deformed shape prior to ignition of said propellant charge, wherein said obturator ring assumes said deformed shape prior to upward movement of said projectile inside said barrel.

10. The projectile of claim 9 wherein said obturator ring reverts to said initial shape when said projectile exits said barrel.

11. The projectile of claim 9, wherein said middle section further comprises a plurality of external longitudinal splines, wherein said obturator ring further comprises a plurality of internal longitudinal splines on its internal surface, said internal splines on said obturator ring being in sliding cooperation with said external splines of said middle section, said internal splines preventing rotation of said ring with respect to said middle section of said projectile, wherein said obturator ring upon deformation engages rifles of a rifled barrel, wherein said obturator ring imparts rotation to said projectile by following said rifles of said barrel as said projectile is propelled inside said barrel.

12. The obturator ring of claim 9 further comprising an annular sealing collar, said collar interfaceable with said annular sealing element on said stop, said collar creating said additional gas seal in cooperation with said annular sealing element.

13. The projectile of claim 9 wherein said obturator ring prior to insertion of said projectile into said barrel is retained in said first position by a retaining element.

14. The projectile of claim 12 wherein said retaining element comprises a coil spring located longitudinally around said middle section of said projectile between said obturator ring and said anvil, said spring compressing during downward movement of said obturator ring when said projectile reaches said sealed end of said barrel, said spring allowing said obturator ring to engage said anvil with energy sufficient to deform said obturator ring.

15. The projectile of claim 12, wherein said retaining element of said obturator ring comprises an annular compliant collar located on said obturator ring, said collar further comprising compliant locking elements, said projectile further comprising an annular retaining groove in said middle section of said projectile, said retaining groove further comprising an annular internal locking shoulder, said locking elements of said obturator ring releasably engaging said locking shoulder of said annular retaining groove, said locking elements disengaging from said locking shoulder when said projectile reaches said sealed end of said barrel, thus releasing said obturator ring.

16. The projectile of claim 12, wherein said retaining element comprises a an annular clip, said clip further comprising an expansion gap, said clip releasably fixed onto said middle section of said projectile between said obturator ring located at said first position and said anvil, said clip inserted and removed onto said projectile by expansion of said expansion gap, said clip removed prior to insertion of said projectile into said barrel.

17. The barrel of claim 9, further comprising a smooth inner surface.

18. The barrel of claim 9, further comprising two sections, namely a) first section and b) second section, wherein said first section is proximal to said open muzzle end, wherein said first section comprises plurality of internal longitudinal helical grooves, wherein said first section is shorter than the total length of said barrel, wherein said second section comprises smooth inner surface, wherein an inner diameter of said second section is greater than the inner diameter of said first section.

19. The second section of the barrel of claim 18 having a length substantially equal to the length of said projectile.

* * * * *